US008007890B2

(12) United States Patent
Yoneda et al.

(10) Patent No.: US 8,007,890 B2
(45) Date of Patent: Aug. 30, 2011

(54) ARTICLE IN A SHEET FORM AND METHOD FOR PREPARATION THEREOF

(75) Inventors: Hisao Yoneda, Okayama (JP); Syuichi Kanao, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 1158 days.

(21) Appl. No.: 10/514,239

(22) PCT Filed: May 19, 2003

(86) PCT No.: PCT/JP03/06212

§ 371 (c)(1),
(2), (4) Date: Jun. 30, 2005

(87) PCT Pub. No.: WO03/097924

PCT Pub. Date: Nov. 27, 2003

(65) Prior Publication Data

US 2005/0266192 A1 Dec. 1, 2005

(30) Foreign Application Priority Data

May 20, 2002 (JP) ..... 2002-144327

(51) Int. Cl.
*B32B 33/00* (2006.01)
*B32B 1/00* (2006.01)
*D06N 3/00* (2006.01)

(52) U.S. Cl. ..... 428/96; 428/36.1; 428/151

(58) Field of Classification Search ..... 428/35.7, 428/36.1, 96, 151
See application file for complete search history.

(56) References Cited

U.S. PATENT DOCUMENTS

| | | | | |
|---|---|---|---|---|
| 4,143,198 | A * | 3/1979 | Sinn et al. | 442/63 |
| 5,503,899 | A | 4/1996 | Ashida et al. | |
| 5,876,466 | A | 3/1999 | Nakashima et al. | |
| 6,159,581 | A | 12/2000 | Yoneda et al. | |
| 6,322,851 | B1 | 11/2001 | Adachi et al. | |
| 6,451,404 | B1 | 9/2002 | Nobuto et al. | |
| 6,479,153 | B1 | 11/2002 | Kato et al. | |
| 6,517,938 | B1 | 2/2003 | Andoh et al. | |
| 6,641,619 | B1 | 11/2003 | Nobuto et al. | |
| 6,739,076 | B2 | 5/2004 | Yoneda et al. | |
| 2003/0022575 | A1 | 1/2003 | Yoneda et al. | |

FOREIGN PATENT DOCUMENTS

| | | |
|---|---|---|
| EP | 1 079 015 | 2/2001 |
| JP | 54-82495 | 6/1979 |
| JP | 63-264975 | 11/1988 |
| JP | 2-234979 | 9/1990 |
| JP | 3-82872 | 4/1991 |
| JP | 6-322664 | 11/1994 |
| JP | 2002-302879 | 10/2002 |

* cited by examiner

*Primary Examiner* — Rena L Dye
*Assistant Examiner* — Walter B Aughenbaugh
(74) *Attorney, Agent, or Firm* — Oblon, Spivak, McClelland, Maier & Neustadt, L.L.P.

(57) ABSTRACT

The sheet material produced in accordance with the invention has soft and enriched texture like natural leather and is suitable as any type of artificial leather for shoes, clothes, gloves and the like, particularly for sports gloves.

13 Claims, No Drawings

ARTICLE IN A SHEET FORM AND METHOD FOR PREPARATION THEREOF

CROSS REFERENCES TO RELATED APPLICATIONS

This application is a national stage application of International Patent Application No. PCT/JP03/06212, filed on May 19, 2003, and claims priority to Japanese Patent Application No. 2002-144327, filed on May 20, 2002, both of which are incorporated herein by reference in their entireties.

TECHNICAL FIELD

The present invention relates to a sheet material with extremely less bleed of softening agent, although the sheet material has natural leather-tone softness.

BACKGROUND OF THE INVENTION

So as to reproduce the soft and enriched texture of natural leather, artificial leather has been treated traditionally with various agents. However, not any such material close to natural leather has been obtained yet. For example, a method for softening artificial leather to the same level as that of natural leather using a certain softening agent has been known traditionally. In other words, it has been carried out to bring about texture close to that of natural leather by adding silicone emulsion processing, wax processing and the like as softening agents. However, the softness and enriched texture of natural leather could not be sufficiently brought about successfully. Additionally, the present inventors proposed a method for giving an oily material and a supporting material thereof to the surface of a fibrous substrate having napped surface, as in accordance with this invention (see Patent Reference 1). However, the method intends to improve the touch (oil tone) of the napped surface. Therefore, the method fundamentally is a technique of attaching a composition including an oily material and a supporting material on the napped part of surface. By the method, accordingly, the overall softness and enriched texture of a fibrous substrate as in accordance with the invention cannot be obtained. By these methods of the related art, in other words, surface touch can be improved, but soft and enriched texture essential to natural leather cannot be reproduced.

Meanwhile, softening process of artificial leather using stuffing agents, for example fish oil and vegetable oil, for use in natural leather can produce a material with texture close to that of natural leather. However, bleed of fats and oils and oils to the surface thereof is distinctly observed. Thus, not any material with great softness and enriched texture close to that of natural leather without any bleed of oily materials such as fats and oils and oils has been obtained yet.

Patent Reference 1

JP-A-2001-131880

It is an object of the invention to provide a sheet material including a fibrous substrate and having great softness and highly enriched texture of natural leather with extremely less bleed of oily materials, as well as a method for producing the same.

DISCLOSURE OF THE INVENTION

So as to solve the problem, the inventors made investigations, to consequently find a sheet material and a method for producing the same as described below.

In other words, the invention relates to a sheet material including the existence of a blend including an oily material with a viscosity of 50 to 10,000 mPa·s at 30° C. and a supporting material thereof, at least in the inside of a fibrous substrate.

Additionally, the sheet material is a sheet material where the fiber composing the fibrous substrate is a microfine fiber of 0.3 dtex or less and where the fibrous substrate includes a fiber-entangled non-woven fabric and an elastic polymer impregnated in the inside thereof.

The preferable supporting material in accordance with the invention includes olefin-series elastomer, aromatic vinyl-series elastomer, an ethylene polymer including a unit with a side chain of a hydrocarbon group with one to 8 carbon atoms at 5 to 60 mol % of the ethylene unit composing the main chain or including a block copolymer including a block of such ethylene polymer, a block copolymer of polymer block A including an aromatic vinyl compound and polymer block B including conjugated diene, or a hydrogenation product thereof. Additionally, preferable mass ratio of the oily material and the supporting material in accordance with the invention is 1/1 to 20/1.

Additionally, the invention relates to a suede-type manmade leather or a grain-type manmade leather, where these sheets include the sheet material of the invention, as well as to a sports glove prepared by using these manmade leather at least partially therein.

The invention also relates to a method for producing a sheet material including preparing a blend including an oily material with a viscosity of 50 to 10,000 mPa·s at 30° C. and a supporting material thereof into an aqueous dispersion, impregnating a fibrous substrate with the aqueous dispersion and fixing the fibrous substrate.

Preferable modes for carrying out the invention are now described below. However, the invention is never limited by the following descriptions.

First, the supporting material composing the invention is a polymeric substance exerting elastomer properties at ambient temperature, namely so-called polymeric substance such that the polymer substance when prepared into a 0.5-mm thick sheet has extension at 100% or more at ambient temperature so the sheet readily deforms when external force is given but resumes its original shape when the force is removed. Further, the mass increment of a powder of the polymer substance is 200% or more because of its absorption of an oily material used in combination therewith, when the powder is impregnated with the oily material, left to stand alone at ambient temperature for 24 hours and subsequently spontaneously filtered. Among them, olefin-series elastomer or aromatic vinyl-series elastomer is preferably used in terms of the retentivity of the oily material. First, olefin-series elastomer as a preferable example of the supporting material of the invention is now described.

The olefin-series elastomer for use in accordance with the invention is a resin including a hydrocarbon chain at the center and has a segment with a glass transition point of 0° C. or less. Such example includes for example EPR (ethylene propylene rubber), EBR (ethylene butylene rubber), HBR (hydrogenated butadiene rubber) and polyisoprene. The method for producing these polymers is known. The main raw material monomer thereof includes for example olefins such as ethylene, propylene, butene, and octene; and cyclic hydrocarbon compounds and diene-series hydrocarbon compounds such as isobutylene, cyclopropene, cyclobutene, cyclopentene, cyclooctene, cyclooctadiene, butadiene, isoprene, and norbornene. These monomers are appropriately mixed together and polymerized by existing polymerization methods for example radical polymerization, an ion polymerization and cation polymerization. So as to increase final physico-chemical properties, particularly weather durability, hydrogenation is preferably done.

Particularly preferable olefin-series elastomer is a copolymer of ethylene and α-olefin. As the α-olefin, for example, propylene, butene, pentene, hexene, heptene, octene and nonene are included. The polymerization method includes for example but is not limited to polymerization, generally in the presence of the Ziegler-Natta catalyst or a metallocene catalyst. In this case, an ethylene polymer wherein the content of a unit with a side chain of a hydrocarbon group with one to 8 carbon atoms is 5 to 60 mol % of the ethylene unit composing the main chain is preferably used owing to the good elastomer properties and the great retentivity of oily material. The molecular weight of such olefin-series elastomer is a number average molecular weight of several tens of thousands to several hundreds of thousands, with no specific limitation. In some case, additionally, a small amount of monomers other than α-olefin may satisfactorily be copolymerized therein. Such monomer includes for example styrene, methyl methacrylate, butyl methacrylate and acrylonitrile.

Aromatic vinyl-series elastomer as one preferable example of the supporting material composing the invention is now described. The aromatic vinyl-series elastomer is a block copolymer of polymer block A including an aromatic vinyl-series compound and polymer block B with a glass transition point of 0° C. or less.

The number of the polymer block A in the block copolymer and the number of the polymer block B therein are not specifically limited. Herein, the polymer block A is simply referred to as A, while the polymer block B is simply referred to as B. Then, the structure of preferable such block copolymer is expressed by structural formulas such as A-B, $(A\text{-}B)_n$, $(A\text{-}B)_n$-A, $(B\text{-}A)_n$-B (provided that $_n$ represents an integer of 1 to 10 in these structural formulas), and $(A\text{-}B)_mX$ (X represents an$_m$-valent residue of a coupling agent and m represents an integer of 2 to 15). Specifically, the triblock copolymer represented by A-B-A is particularly preferable in terms of the retentivity of oily material. For the retentivity of oily material, the content of an aromatic vinyl compound in the block copolymer is preferably 5 to 75% by mass, more preferably 10 to 65% by mass.

The aromatic vinyl compound composing the polymer block A in the block copolymer includes for example styrene, α-methylstyrene, o-, m- or p-methylstyrene, 1,3-dimethylstyrene, vinylnaphthalene, and vinylanthracene. Among them, styrene or α-methylstyrene is preferable in terms of softness. Such aromatic vinyl compound may be used singly or in combination with two or more thereof.

Additionally, any polymer with a glass transition point of 0° C. or less is satisfactory as the polymer composing the polymer block B in the block copolymer, with no specific limitation. In terms of softness, polymers of conjugated diene or hydrogenation products thereof are particularly preferable. Such conjugated diene includes for example 1,3-butadiene, isoprene, 2,3-dimethyl-1,3-butadiene, 1,3-pentadiene, and 1,3-hexadiene. Among them, preferable are isoprene, 1,3-butadiene or mixtures thereof in terms of softness and preventing the bleed of oily material onto surface. Conjugated diene may be used singly or in combination of two or more thereof.

Among them, generally, resins such as SBS (triblock copolymer including styrene polymer block-butadiene polymer block-styrene polymer block), SEBS (triblock copolymer including styrene polymer block-ethylene.butadiene copolymer block-styrene polymer block), SEPS (triblock copolymer including styrene polymer block-ethylene.propylene copolymer block-styrene polymer block), SIS (triblock copolymer including styrene polymerblock-isoprene polymerblock-styrene polymer block), and SEEPS (triblock copolymer including styrene polymer block-ethylene.ethylene.propylene copolymer block-styrene polymer block) can be used as preferable block copolymers in terms of the retentivity of such oily material and the texture of the resulting fiber substrate.

With no specific limitation, the number average molecular weight of the block copolymer is preferably 50,000 to 500,000, more preferably 100,000 to 400,000. When the number average molecular weight is less than 50,000, the retentivity of such oily material is deteriorated. Above 500,000, the softness is deteriorated.

Such block copolymers have already been known. As the method for producing such copolymers, for example, the following known anion polymerization method can be used. Specifically, an aromatic vinyl compound and conjugated diene are polymerized together in an inert organic solvent such as n-hexane and cyclohexane, using for example an alkyl lithium compound as an initiator, to prepare such block copolymer. If desired, then, coupling agents such as dichloromethane, carbon tetrachloride and tetrachlorosilane may be used.

In case that the block copolymer is to be a hydrogenation product of such a block copolymer as described above, such block copolymer is hydrogenated in the presence of a hydrogenation catalyst in an inert organic solvent by known methods, to obtain a hydrogenated block copolymer.

In accordance with the invention, further, the block copolymer or a hydrogenated block copolymer as the hydrogenation product thereof is used as the supporting material. From the standpoints of thermal resistance and weather durability, the hydrogenated block copolymer is more preferable, where 70% or more of the carbon-carbon double bonds derived from conjugated diene in the block copolymer before hydrogenation is still more preferably hydrogenated. The content of the carbon-carbon double bonds in the polymer block B in the hydrogenated block copolymer can be determined by iodine value determination, infrared spectrophotometer, nuclear magnetic resonance and the like. In addition to the two types of the blocks, other monomers may satisfactorily be copolymerized in a block form or randomly, within a range with no deterioration of the invention. Further, the styrene-series elastomer may satisfactorily include styrene-containing rubber such as SBR (styrene butadiene rubber) other than the block copolymer described above.

Concerning the resin composing the supporting material for use in accordance with the invention, additionally, the resin may contain functional groups such as carboxyl group, hydroxyl group, acid anhydride group, amino group and epoxy group within the molecular chain or at molecular ends thereof, unless the scope of the invention is deteriorated.

The oily material to be blended in such supporting material should essentially be a fluid material with a viscosity of 50 to 10,000 mPa·s at 30° C. and with no miscibility with water at ambient temperature so that the oily material is separated from water into a phase. In case that the viscosity is less than 50 mPa·s, the oily material after coating on the substrate starts to bleed. In case that the viscosity exceeds 10,000 mPa·s, the oily material is never miscible with the supporting material, so that the resulting sheet material has poor oil tone and lacks softness. Thus, such oily material is not suitable.

Specific examples of the oily material type include paraffin-series or naphthene-series process oil, white oil, mineral oil, oligomer of ethylene with α-olefin, paraffin wax, fluid paraffin, silicone oil, vegetable oil and aromatic oil. These may be used singly or in mixture. Among them, paraffin-series process oil is preferable because the process oil has an oil tone similar to that of natural leather.

In accordance with the invention, preferably, the mass ratio between the supporting material (1) and the oily material (2) is (2)/(1)=1 to 20. When the mass ratio is less than 1, soft texture is hardly brought about. When the mass ratio exceeds 20, the bleed of the oily material readily occurs. More preferably, the mass ratio is within a range of (2)/(1)=3 to 12.

In accordance with the invention, the type and molecular weight of the supporting material (1), the type of the oily material (2), the mass ratio of two or more oily materials when used in mixture, the ratio (2)/(1), and the amounts thereof to be given to the inside of the fibrous substrate can be modified to reproduce the desired softness and enriched texture of natural leather.

The method for giving them to the inside of the fibrous substrate includes for example a step of dissolving a blend including an oily material with a viscosity of 50 to 10,000 mPa·s at 30° C. and a supporting material thereof in a good solvent to prepare a solution, a step of impregnating the fibrous substrate with the solution, a step of removing the solvent and a step of fixing the fibrous substrate. However, a method including a step of preparing a blend including an oily material with a viscosity of 50 to 10,000 mPa·s at 30° C. and a supporting material thereof into an aqueous dispersion, a step of impregnating the fibrous substrate with the aqueous dispersion, and a step of drying and fixing the fibrous substrate should be selected from an environmental standpoint and a quality standpoint such that great softness and enriched texture like those of natural leather can be finally yielded with scarce formation of continuous film during impregnation.

The order to give them to the inside of the fibrous substrate is not specifically limited. As long as the supporting material and the oily material are contained in the inside of the final product, the advantages of the invention can be exerted. In case of intending the preparation of suede-type artificial leather including microfine fiber and being fully covered with nap, however, the above process is preferably done after dyeing because the oily component is then less dissociated during dyeing so that the process can be controlled very easily.

The fibrous substrate for use in accordance with the invention is now described. As such, known fibrous substrates can be used, with no specific limitation. Known fibrous substrates can be used, including for example woven fabric, non-woven fabric, knitted fabric or products prepared by impregnating these fabrics with polymeric elastomers, entangled non-woven fabric or products prepared by impregnating the fabric with polymeric elastomers, microfine fiber-entangled non-woven fabric, or products prepared by impregnating the fabric with polymeric elastomers.

A fibrous substrate prepared by impregnating a non-woven fabric entangled with a microfine fiber composed of a fiber of 0.3 dtex or less with a polymeric elastomer is preferably used because the resulting sheet material can get softness like natural leather. A range of 0.1 to 0.0001 dtex is more preferable. When the fiber is thick above 0.3 dtex, the texture of the napped surface of the resulting intended suede-type man-made leather is rough, leading to the deterioration of the appearance. When the thickness of the fiber is less than 0.0001 dtex, the break strength of the fiber is decreased, so that the peel strength and break strength of the resulting layer are decreased and additionally, no sufficient coloring is likely to be obtained.

The method for producing such microfine fiber typically includes for example a method including a step of producing microfine fiber-forming fibers by methods such as a method for producing a fiber of sea-island structure by for example a mix spinning method and a composite spinning method of sea-island type, using two or more polymers with immiscibility with each other at their molten states and with difference in solubility or decomposition, and a method for producing a division type composite fiber by a composite spinning method, and a subsequent step of extracting and removing or decomposing and removing a part thereof (for example, the sea component) to prepare a microfine fiber; or a method including a step of releasing polymers in a division type composite fiber from each other at the interface thereof to prepare a microfine fiber. Other than these methods described above, methods such as so-called melt-blow method including injecting a fiber-forming polymer from a melt spinning nozzle and immediately blowing the polymer off with a high-speed gas to make the resulting fiber thin may also be used. Due to the control of fiber thickness and the stability of the resulting microfine fiber, however, the method en route the microfine fiber-forming fiber is preferable.

The resin composing the microfine fiber in accordance with the invention includes for example but is not limited to aromatic polyesters such as polyethylene terephthalate, polypropylene terephthalate, polybutylene terephthalate, polyethylene naphthalate, and copolymer polyesters mainly including them; polyamides such as nylon-6, nylon-66, and nylon-610; and polyolefins such as polyethylene and polypropylene. Among them, the aromatic polyesters and polyamides described above are preferable because artificial leather with natural leather tone can be produced from them and the dyeability thereof is great. To these resins may satisfactorily be added pigments typically including carbon black, coloring agents such as dyes and known stabilizers typically including ultraviolet preventive agents, within a range without any deterioration of the stability during spinning.

Additionally, examples of the resin component composing the microfine fiber-forming fiber, which are to be extracted and removed or decomposed and removed, include at least one polymer selected from polymers such as polyethylene, polypropylene, ethylene-propylene copolymer, ethylene-vinyl acetate copolymer, polystyrene, styrene-acrylic monomer copolymer, styrene-ethylene copolymer and copolymer polyester. Among them, polyethylene, polystyrene or copolymers mainly including them are preferable due to ready extraction.

As a method for forming a fibrous substrate including an entangled non-woven fabric including the microfine fiber or microfine fiber-forming fiber and an elastic polymer impregnated in the inside thereof, known methods are used. For example, the method can be successfully attained by sequentially carrying out a step of producing an entangled non-woven fabric including the microfine fiber-forming fiber, a step of impregnating the entangled non-woven fabric with an elastic polymer solution for solidification, and a step of modifying the microfine fiber-forming fiber into a microfine fiber. It is needless to say that the step of modification into microfine fiber and the step of impregnation with the elastic polymer solution for solidification may be carried out in an inversed order.

The method for producing such entangled non-woven fabric using the microfine fiber-forming fiber includes a method of treating the microfine fiber-forming fiber by spinning, drawing, thermal fixation, crimping, and cutting by methods having been known traditionally, to prepare a staple of the fiber, splitting such staple with a curd to form a random web or cross-lap web with a weber, and laminating the resulting web together if necessary to adjust the web to a desired weight. Then, the weight of the web is appropriately selected, depending on the field of a final intended use. Generally, the weight is preferably within a range of 100 to 3,000 g/m$^2$. For the purpose of the preparation at low cost, efficiently, two sheets of a fibrous substrate can be produced at once efficiently by impregnating a entangled non-woven fabric of amass about 2-fold the required mass with an elastic polymer solution for solidification and dividing the resulting non-woven fabric by halves along the thickness direction with a band knife.

Subsequently to the lamination of the web, the laminate is treated at an entangling process by known methods for example needle punching method or high-pressure water jet method to form an entangled non-woven fabric. Generally, conditions in case of needle punching method are preferably set within a range of 200 to 2,500 punch/cm$^2$, although the range varies depending on the shape of used needle and the thickness of the web.

Prior to the impregnation treatment with an elastic polymer, the entangled non-woven fabric is treated by known methods such as thermal press if necessary for smoothing the surface. In case that the fiber composing the entangled non-woven fabric is a fiber of a sea-island structure including polyethylene as the sea component and polyester or polyamide as the island component, polyethylene as the sea component is fused together by thermal press, to fix the fiber together via adhesion to prepare an entangled non-woven fabric with great surface smoothness. In case that the fiber composing the entangled non-woven fabric is not in a sea-island structure which can be modified into a microfine fiber by dissolving and removing one component therein, preferably, the fiber surface is covered with a temporary filler such as polyvinyl alcohol prior to the impregnation treatment with an elastic polymer, from which the temporary filler is removed after the elastic polymer is given, so as to prevent the fixation of the elastic polymer used for impregnation to make the texture hard. In case that the fiber composing the entangled non-woven fabric is in a sea-island structure which can be modified into a microfine fiber by dissolving and removing one component therein, the temporary filler is given at the stage of the entangled non-woven fabric to cover the surface of the multi-component fiber, and the temporary filler is then removed after the elastic polymer is given, to prepare a softer sheet.

As the resin for impregnation of the entangled non-woven fabric, known elastic polymers can be used, including for example natural rubber, styrene-butadiene copolymer, acrylonitrile-butadiene copolymer, polyurethane elastomer, other synthetic rubber or mixtures thereof. Among them, polyurethane resin is preferably used in view of great texture. Preferable polyurethane resin includes so-called segmented polyurethane obtained by using at least one polymer diol with a number average molecular weight of 500 to 5,000 as soft segment, which is selected from the group consisting of polyester-series diol, polyacetone-series diol, polycarbonate-series diol, polyether-series diol and polyether ester-series diol as obtained by reacting diol with dicarboxylic acid or a derivative thereof with an ability to form ester, and then reacting this polymer diol with a diisocyanate compound and an extension agent of low-molecular chain.

The diol compound for use in the synthesis of the polymer diol composing the soft segment is preferably aliphatic compounds with 6 or more carbon atoms to 10 or less carbon atoms in terms of durability or leather-like texture and includes for example 3-methyl-1,5-pentane diol, 1,6-hexane diol, 2-methyl-1,8-octane diol, 1,9-nonane diol, and 1,10-decane diol. Further, typical examples of the dicarboxylic acid include for example aliphatic dicarboxylic acids such as succinic acid, glutaric acid, adipic acid, azelaic acid, and sebacic acid; and aromatic dicarboxylic acids such as terephthalic acid and isophthalic acid.

In case that the number average molecular weight of polymer diol is less than 500, unpreferably, the resulting sheet material lacks softness so that no natural leather-like texture can be obtained. In case that the number average molecular weight of polymer diol exceeds 5000, further, a manmade leather balanced in softness, durability, thermal resistance and hydrolysis resistance can hardly be obtained because the concentration of urethane group is decreased therein. The diisocyanate compound includes aromatic, aliphatic and alicyclic diisocyanate compounds such as 4,4'-diphenylmethane diisocyanate, xylylene diisocyanate, tolylene diisocyanate, isophorone diisocyanate, dicyclohexylmethane-4,4'-diisocyanate, and hexamethylene diisocyanate.

Additionally, the extension agent of low-molecular chain includes for example low-molecular compounds with a molecular weight of 300 or less and with two active hydrogen atoms, such as ethylene glycol, propylene glycol, butane diol, hexane diol, N-methyldiethanolamine, ethylenediamine, diaminodiphenylmethane, diaminodicyclohexylmethane, and isophorone diamine.

The method for synthetically preparing polyurethane may include one-shot method or prepolymer method.

If necessary, further, solidification adjusters, stabilizers and the like may satisfactorily be added to polyurethane, within a range without any deterioration of the object of the invention. Further, other polymers may be used in combination. Additionally, coloring agents such as carbon black and dyes may be added.

The method for allowing the entangled non-woven fabric to contain polyurethane, from the standpoint of obtaining balanced texture, includes for example but is not limited to a method including directly impregnating the entangled non-woven fabric with a polyurethane solution prepared by diluting polyurethane with a good solvent for polyurethane, typically including dimethylformamide or with an aqueous polyurethane dispersion and squeezing the resulting fabric with a mangle, if necessary, a method including coating the fabric with a polyurethane solution or an aqueous polyurethane dispersion by coaters to infiltrate the solution or the dispersion into the fabric. By wet solidification or dry solidification of the impregnated polyurethane solution, polyurethane is contained in the entangled non-woven fabric. From the standpoint of obtaining natural leather-like texture and touch, in particular, wet solidification is preferable. From the standpoint of natural leather-like soft texture, additionally, the mass ratio between the fiber composing the fibrous substrate and polyurethane is preferably within a range of 30/70 to 90/10, more preferably within a range of 35/65 to 80/20. When the fiber ratio is too small compared with the range, the resulting manmade leather has rubber-like texture. When the fiber ratio is too high, the resulting sheet has such paper-like texture. Therefore, the intended natural leather-like texture cannot be obtained.

In case of using a fiber of sea-island structure, the entangled non-woven fabric is impregnated with polyurethane and subsequently treated with a liquid functioning as a solvent-free for polyurethane and the island component of the microfine fiber-forming fiber and functioning as a solvent or decomposition agent for the sea component of the microfine fiber-forming fiber, to modify the microfine fiber-forming fiber into a microfine fiber bundle, to prepare a fibrous substrate including the microfine fiber-entangled non-woven fabric and polyurethane. It is needless to say that a method for modifying the microfine fiber-forming fiber into a microfine fiber bundle prior to impregnation with polyurethane may also be used to prepare a fibrous substrate. In case of using a releasable composite fiber of division type, further, a method may be possible including treating the fiber with a liquid promoting the release, to release the fiber at the interface of the fiber-composing polymers to prepare a microfine fiber bundle.

Then, the resulting fibrous substrate can be finally prepared into manmade leathers with the surface processed by known finish techniques, such as suede-type manmade leather with at least one face being napped or grain-type manmade leather with the surface prepared with a polymeric elastomer. The fibrous substrate including the resulting microfine fiber-entangled non-woven fabric and polyurethane is napped by known methods typically including buffing with sand paper and needle cloth, and smoothing nap. Because the nap length raised has influences on the appearance and the appearance thereof after coating with a supporting material containing an oily material, the nap length is adjusted by selecting conditions for buffing and nap smoothing, for example the sand paper No. for use in buffing, the grind speed and the pressure at which the substrate is pressed. Nap may satisfactorily exist on the whole surface of a single face of the resulting sheet or on the whole surface of both the faces thereof, or may exist in a spot form on a part of a single face or both the faces thereof.

Known dyeing methods for dyeing knitted woven fabric or non-woven fabric can be used as the dyeing method, with no specific limitation. Additionally, known dyes may satisfactorily be used as the dye for use. In one example, satisfactorily, dispersion dyes are used in case that the resin on the napped part of the fibrous substrate is polyester, while acid dyes; sulfur dyes and vat dyes are used in case that the resin thereon is polyamide; and cation dyes are used in case that the resin thereon is acryl. Further, any known dyeing machines can be used with no specific limitation, including for example circular, wince, dash line, washer dyeing machine, Tyco dyeing machine and continuous dyeing machine.

A blend including the oily material and a supporting material thereof is given to the inside of the fibrous substrate thus obtained. The method for giving the blend includes for example impregnation-liquid squeezing method with mangle, coating method, and spray method. Among them, the impregnation-liquid squeezing method with mangle is preferably used. The object of the invention can first be achieved by the presence of the blend including the oily material and the supporting material in the inside of the fibrous substrate. In case that the oily material and the supporting material exists only on the surface but is absent in the inside, the natural leather-tone softness and superior enriched texture as intended in accordance with the invention cannot be attained.

The ratio between the fibrous substrate in accordance with the invention and the blend including the oily material and the supporting material thereof is preferably within a range of 5 to 80%, more preferably within a range of 10 to 50% of the fibrous substrate, in view of natural leather-tone softness and texture. When the ratio is less than 5%, oil tone is so poor that the resulting sheet is likely to have hard texture. When the ratio exceeds 80%, the sticky touch of oil is likely to be enhanced.

In case that the sheet material of the invention is used to prepare a suede-type manmade leather, the presence of the blend in a manner limited to the inside of the sheet can bring about soft sheet without any modification of the surface suede texture.

The suede-type manmade leather thus obtained is useful as a material not only for shoes but also as materials for gloves, bags, and clothes and sometimes as a material for sports gloves.

EXAMPLES

The invention is now described specifically in Examples, but the invention is not limited by these Examples. The term "part" in the Examples relates to mass unless otherwise stated.

The thickness of fiber was determined using an photomicrograph of the cross section of the fiber and on the basis of the mean of the cross-sectional area thereof.

In the Examples, softness and enriched touch were determined by the inventors, when they grasped manmade leather with hands at various intensities or when they wore sports gloves prepared using manmade leather on hands and then opened or closed their hands to feel general texture of the sports gloves. The results of their assessment were expressed as follows.

Great: circle

Good: triangle

Poor: x.

Further, oil bleed (bleed) was assessed by the following method, including by determining whether or not oily matters were deposited on hands when manmade leather was strongly held with clean washed hands, whether or not oily matters were deposited on hands when sports gloves prepared using manmade leather were worn on clean washed hands and the hands were then strongly closed or opened, or the extent of the deposition. The results of their assessment were expressed as follows.

Great: circle

Good: triangle

Poor: x.

Example 1

Nylon-6 and polyethylene were mixed together at their chip states at a mass ratio of 50:50 for melt spinning with an extruder, to spin a fiber of a sea-island structure where polyethylene was the sea component and nylon-6 was the island component; by drawing, crimping and cutting, a staple of 4 dtex and 51-mm length was prepared to prepare a cross-lap with a webber, which was then treated by needle punching at 700 punch/cm$^2$, using a needle punching machine to finally obtain an entangled non-woven fabric. The non-woven fabric was impregnated with a dimethylformamide (sometimes abbreviated as DMF hereinafter) solution of a polyurethane resin including poly (3-methylpentane) adipate diol and polyethylene glycol as polymer diols of a mean molecular weight of 2000 for soft segment, followed by wet solidification, from which polyethylene as the sea component of the fiber was extracted into perchloroethylene, to prepare a fibrous substrate with a weight of 450 g/m$^2$, a thickness of 1.3 mm and a polyurethane to fiber ratio of 40/60. The fineness level of the nylon microfine fiber in the resulting substrate was 0.006 dtex on average. The single face of the resulting substrate was buffed with a sand paper, to prepare a sheet material including the nylon microfine fiber and having a napped surface. The sheet material was dyed under the following conditions with a circular dyeing machine, to obtain suede-type manmade leather in brown.

Dyeing Conditions

Dye:

Lanacron Brown S-GR (manufactured by Ciba Specialty Chemicals K.K.); 5% owf

Irgalan Yellow GRL (manufactured by Ciba Specialty Chemicals K.K.); 2% owf

Bath ratio: 1:30

Dyeing temperature: 90° C.

Using then a hydrogenated styrene-(ethylene.ethylene.propylene)-styrene triblock copolymer of a number average molecular weight of about 290,000 ("Septon 4055" elastomer manufactured by Kuraray Co., Ltd.; hydrogenation ratio of 98%; after the copolymer was left to stand in the following oily material at ambient temperature for 24 hours, the mass increment was 1600%) as a supporting material, a paraffin-series oil at an 8-fold mass ratio as an oily material ("PW-90" manufactured by Idemitsu Kosan Co., Ltd.; viscosity at 30° C.: 140 mPa·s) was blended in the supporting material, to prepare an aqueous dispersion (mean particle diameter of 1 μm) at a concentration of the non-volatile components at 30%.

Using a mangle, the aqueous dispersion was impregnated into the suede-type manmade leather dyed in brown to a liquid squeezing ratio of 70%, which was then dried in a dryer at 60° C. to prepare a suede-type manmade leather at a mass ratio of the blend including the oily material and the supporting material thereof to the fibrous substrate being 20%. The resulting suede-type manmade leather had great natural leather-tone softness and enriched texture. Additionally, no oil bleed existed.

Using the resulting suede-type manmade leather, sports gloves were prepared. The sports gloves had soft texture without any oil bleed onto the surface and were greatly fitted for hands.

Further, the gloves were washed under the conditions according to the method A-1 described in JIS L0884 and dried at 70° C., for wear test. Because of almost no dissociation of the blend given, the soft texture was retained while the gloves were greatly fitted for hands.

Example 2

The aqueous dispersion prepared in Example 1 was impregnated into the suede-type manmade leather dyed in brown as prepared in Example 1 with a mangle, to a liquid squeezing ratio of 60%, which was then dried in a dryer at 90° C. to prepare a suede-type manmade leather at a mass ratio of the blend including the oily material and the supporting material thereof to the fibrous substrate being 18%. The resulting suede-type manmade leather had great natural leather-tone softness and enriched texture. Additionally, no oil bleed existed.

Using the resulting suede-type manmade leather, sports gloves were prepared. The sports gloves had soft texture without any oil bleed onto the surface and were greatly fitted for hands.

Further, the gloves were washed under the conditions according to the method A-1 described in JIS L0884 and dried at 70° C., for wear test. Because of almost no dissociation of the blend given, soft texture was retained while the gloves were greatly fitted for hands.

Example 3

The fibrous substrate obtained in Example 1 was sliced along the direction of the thickness thereof with a slicer into two sheets. Further, the sliced face was ground with a buff machine, to prepare a fibrous substrate of a thickness of 0.5 mm. The fibrous substrate was dyed into black under the following conditions with a circular dyeing machine and then dried, to prepare a fibrous substrate in gray.

| Dyeing conditions<br>Dye:Kayakalan Black 2RL (manufactured by Nippon Kayaku Co., Ltd.) | |
|---|---|
| Dye concentration: | 2% OWF |
| Leveling agent: | 2 g/l |
| Dyeing temperature: | 90° C. |
| Dyeing period: | 60 minutes |

The fibrous substrate in gray was dry treated of the surface under the following conditions.

| Surface-treating conditions<br>Release paper:DE-123 (Dai Nippon Printing Co., Ltd.) | |
|---|---|
| Composition of top layer | |
| NY-324 (manufactured by Dainippon Ink and Chemicals Incorporation) | 100 parts |
| L-1770S (Dilac color; manufactured by Dainippon Ink and Chemicals, Inc.) | 20 parts |
| DMF | 35 parts |
| Composition of adhesive agent | |
| Leathermine UD 8310 (manufactured by Dainichiseika Color and Chemicals Mfg. Co., Ltd.) | 100 parts |
| Takenate D-110 N (manufactured by Takeda Pharmaceutical Company Limited) | 10 parts |
| Accelerator Accel QS (manufactured by Dainippon Ink and Chemicals, Inc.) | 2 parts |
| Ethyl acetate | 20 parts |

The cross section of the resulting grain-type manmade leather was photographed with a scanning electron microscope, to measure the thickness of the resin layer on the surface-treated (grain) part. The top layer was 15 Mm, while the adhesive layer was 35 μm. The aqueous dispersion used in Example 1 was impregnated into the grain-type manmade leather with a mangle to a liquid squeezing ratio of 60%, which was then dried in a dryer at 90° C. to prepare a grain-type manmade leather at a mass ratio of the blend including the oily material and the supporting material thereof to the fibrous substrate being 18%. The resulting grain-type manmade leather was then crimped with a tumbler dryer, to prepare a grain-type manmade leather in black. The resulting grain-type manmade leather had great natural leather-like softness and enriched texture. Additionally, no oil bleed existed. Further, the grain-type manmade leather was most suitable for clothes, gloves and bags.

Using the resulting grain-type manmade leather, sports gloves were prepared. The sports gloves had soft texture without any oil bleed onto the surface and were greatly fitted for hands.

Further, the gloves were washed under the conditions according to the method A-1 described in JIS L0884 and dried at 70° C., for wear test. Because of almost no dissociation of the blend given, soft texture was retained while the gloves were greatly fitted for hands.

Example 4

For preparing a fibrous substrate by the same method as in Example 1, the mass of the non-woven fabric after needling was adjusted to 700 g/m$^2$. Subsequent impregnation with polyurethane, solidification and extraction were done by the same methods as in Example 1, to obtain a substrate of a weight of 705 g/m$^2$ and a thickness of 2.1 mm. The surface of the fibrous substrate was coated under the following conditions and was subsequently charged in aqueous 5% DMF solution to solidify polyurethane, to prepare a black foam layer (thickness of 500 μm) on one face of the fibrous substrate.

| Coating conditions | |
|---|---|
| Composition of foam layer | |
| Crisbon MP-105 (manufactured by Dainippon Ink and Chemicals, Inc.) | 100 parts |
| DILAC L6001 (manufactured by Dainippon Ink and Chemical, Inc.) | 10 parts |
| Crisbon Assister SD-7 (manufactured by Dainippon Ink and Chemicals, Inc.) | 2 parts |
| Crisbon Assister SD-11 (manufactured by Dainippon Ink and Chemicals, Inc.) | 1 part |
| Crisbon Assister SD-17 (manufactured by Dainippon Ink and Chemicals, Inc.) | 2 parts |
| DMF | 60 parts |
| Coating amount | 300 g/m$^2$ |

The foam layer was embossed in a calf-like tone with an emboss machine, to prepare a grain-type manmade leather. The aqueous dispersion prepared in Example 1 was used for impregnation of the grain-type manmade leather with a mangle, to a liquid squeezing ratio of 60%, which was then dried in a dryer at 90° C., so that the mass ratio of the blend including the oily material and the supporting material thereof to the fibrous substrate was 18%. Subsequently, the sheet was crimped with a tumbler dryer to prepare a black grain-type manmade leather with great natural leather-tone enriched and soft texture. The resulting grain-type manmade leather was the most suitable for gloves, shoes and the like.

Example 5

The supporting material and the oily material in Example 1 were changed to EPR (EP 961 SP: elastomer manufactured by JSR: after the elastomer was left in the following oily material at ambient temperature for 24 hours, the mass increment was 1500% and the content of hydrocarbon groups in the side chain was 20 mol %) as a supporting material and a paraffin-series oil at a 2-fold mass ratio as an oily material (PW-380: manufactured by Idemitsu Kosan Co., Ltd.; the viscosity at 30° C. was 600 mPa·s). These were blended together to prepare an aqueous dispersion at a concentration of the non-volatile components being 30%. By the same method as in Example 1 except for the use of the aqueous dispersion in place of the blend in Example 1, suede-type manmade leather was prepared. The mass ratio of the blend including the oily material and the supporting material thereof to the fibrous substrate composing the resulting suede-type manmade leather was 20%. The resulting suede-type manmade leather had great natural leather-like softness and enriched texture. Additionally, no oil bleed existed.

Using the resulting suede-type manmade leather, sports gloves were prepared. The sports gloves had soft texture without any oil bleed onto the surface and were greatly fitted for hands.

Further, the gloves were washed under the conditions according to the method A-1 described in JIS L0884 and dried at 70° C., for wear test. Because of almost no dissociation of the blend given, soft texture was retained while the gloves were greatly fitted for hands.

Comparative Example 1

In the same manner as in Example 1 except for no use of the blend of Example 1, a suede-type manmade leather was obtained. The resulting suede-type manmade leather was like rubber without any oil tone and had poorly enriched texture. The texture was greatly inferior compared with the suede-type manmade leather of Example 1. Using the resulting suede-type manmade leather, sports gloves were prepared. The sports gloves had poorer enriched touch and harder texture and were more poorly fitted for hands, compared with the sports gloves obtained in Example 1.

Comparative Example 2

In the same manner as in Example 1 except for the use of an aqueous solution of a silicone-series softening agent ("Nicca silicone AM-204" at a solid concentration of 20% as manufactured by Nicca Chemical Co., Ltd.) for the fibrous substrate in place of the blend of Example 1, a suede-type manmade leather was obtained. The resulting suede-type manmade leather lacked the enriched touch unique to oil and had a texture absolutely different from the natural leather-tone texture, although the sheet had softness.

Using the resulting suede-type manmade leather, sports gloves were prepared. The sports gloves had poorer enriched touch, compared with the sports gloves obtained in Example 1.

Further, the gloves were washed under the conditions according to the method A-1 described in JIS L0884 and dried at 70° C., for wear test. The silicone-series softening agent given was almost totally dissociated. The texture of the gloves changed to hard texture, and the gloves were poorly fitted for hands.

Comparative Example 3

Using the suede-type manmade leather dyed in brown at a state with no impregnation with any blend, as produced in Example 1, the sheet was impregnated with the stuffing agent (sulfonated natural oil) for use in natural leather and was then dried, to the impregnation of a stuffing agent at a mass ratio of the stuffing agent to the fibrous substrate composing the suede-type manmade leather being 16%. The texture of the resulting suede-type manmade leather had great enriched texture and softness. However, the stuffing agent was deposited much on hands or paper, when the suede-type resulting manmade leather was held with the hands and additionally when the sheet was simply laid on the paper. Thus, the bleed of the stuffing agent was distinct. Using the resulting suede-type manmade leather, sports gloves were prepared. The sports gloves had softness and enriched texture, comparable to those of the sports gloves obtained in Example 1. After the gloves were taken off however, very unpleasant sticky touch remained on hands.

Further, the gloves were washed under the conditions according to the method A-1 described in JIS L0884 and dried at 70° C., for wear test. The stuffing agent given was almost totally dissociated. The texture of the gloves changed to hard texture, and the gloves were poorly fitted for hands.

Comparative Example 4

The same oily material and supporting material as in Example 1 were blended together at the same ratio as in Example 1. Subsequently, the resulting blend was not prepared into an aqueous dispersion but was dissolved in toluene to prepare a toluene solution (at 20% of the non-volatile components).

In the same manner as in Example 1 except for no use of the blend in Example 1, a suede-type manmade leather in brown was obtained. The toluene solution (at 20% of the non-volatile components) was coated on the napped surface of the resulting brown suede-type manmade leather to a solid deposition of about 7 g/m$^2$ with a gravure roll of 55 mesh, and was then dried to evaporate toluene. The blend was deposited only on the napped surface of the resulting suede-type manmade leather. No oil bleed existed. However, the texture lacked both softness and enriched touch, and was not significantly different from that of the suede-type manmade leather after dyeing. Using the resulting suede-type manmade leather, sports gloves were prepared. Compared with the sports gloves obtained in Example 1, the sports gloves had poorer softness and no enriched texture and were poorly fitted as well.

Further, the gloves were washed under the conditions according to the method A-1 described in JIS L0884 and dried at 70° C., for wear test. The dissociation of the blend deposited only on the napped surface was not observed, but the hard texture prior to washing never changed. The gloves were poorly fitted for hands.

The properties of the manmade leathers obtained in the above Examples and Comparative Examples are shown in Table 1.

INDUSTRIAL APPLICABILITY

The sheet material of the invention has both enriched and soft textures similar to those of natural leather and has good durability against washing. Suede-type manmade leather and grain-type manmade leather prepared from the sheet material of the invention are suitable for any applications such as shoes, clothes, gloves or bags or interior articles. Such sheet is particularly useful for the application to sports gloves owing to the great softness, enriched touch and fittingness.

TABLE 1

| Item | Softness | Enriched touch | Oil bleed |
|---|---|---|---|
| Example-1 | ○ | ○ | ○ |
| Example-2 | ○ | ○ | ○ |
| Example-3 | ○ | ○ | ○ |
| Example-4 | ○ | ○ | ○ |
| Example-5 | ○ | ○ | ○ |
| Comparative Example-1 | x | x | ○ |
| Comparative Example-2 | ○ | x | ○ |
| Comparative Example-3 | ○ | ○ | x |
| Comparative Example-4 | x | x | ○ |

The invention claimed is:

1. A sheet material, comprising:

a blend of (1) an oily material with a viscosity of 50 to 10,000 mPa·s at 30° C. and (2) a supporting material for said oily material, wherein the mass ratio between said oily material and said supporting material is 1/1 to 20/1, said blend being distributed at least throughout the inside of a fibrous substrate of said sheet material.

2. The sheet material according to claim 1, wherein said fibrous substrate comprises a microfine fiber of 0.3 dtex or less.

3. The sheet material according to claim 1, wherein the fibrous substrate comprises a fiber-entangled non-woven fabric and an elastic polymer impregnated into the inside of said fiber-entangled non-woven fabric.

4. The sheet material according to claim 1, wherein said supporting material is an olefin-series elastomer.

5. The sheet material according to claim 1, wherein said supporting material is an aromatic vinyl-series elastomer.

6. The sheet material according to claim 1, wherein said supporting material is an ethylene polymer comprising a unit with a side chain of hydrocarbon groups with one to 8 carbon atoms at 5 to 60 mol % of the ethylene unit comprising the main chain or comprising a block copolymer comprising a block of ethylene polymer.

7. The sheet material according to claim 1, wherein said supporting material is a block copolymer comprising polymer block A which comprises an aromatic vinyl compound and polymer block B which comprises conjugated diene, or is a hydrogenation product thereof.

8. A suede-type manmade leather comprising said sheet material according to claim 1.

9. A grain-type manmade leather comprising said sheet material according to claim 1.

10. A sports glove comprising said manmade leather according to claim 8.

11. A sports glove comprising said manmade leather according to claim 9.

12. A sheet material, comprising:

a blend which is distributed at least throughout the inside of a fibrous substrate, said blend comprising (1) an oily material with a viscosity of 50 to 10,000 mPa·s at 30° C., and (2) a supporting material for said oily material, wherein the mass ratio between said oily material and said supporting material is 1/1 to 20/1, wherein a mass ratio of the blend to the fibrous substrate is within a range of 5 to 80%.

13. The sheet material according to claim 12, wherein the fibrous substrate comprises a fiber-entangled non-woven fabric and an elastic polymer impregnated into the inside of said fiber-entangled non-woven fabric.

* * * * *